US010302074B2

(12) United States Patent
Trieb et al.

(10) Patent No.: US 10,302,074 B2
(45) Date of Patent: May 28, 2019

(54) HYDRAULIC DRIVE FOR A PRESSURE BOOSTER

(75) Inventors: Franz Trieb, Kapfenberg (AT); Rene Stuehlinger, Oberaich (AT); Rene Moderer, Tragoess (AT)

(73) Assignee: BHDT GmbH, Kapfenberg (AT)

( * ) Notice: Subject to any disclaimer, the term of this patent is extended or adjusted under 35 U.S.C. 154(b) by 691 days.

(21) Appl. No.: 13/467,706

(22) Filed: May 9, 2012

(65) Prior Publication Data

US 2013/0167951 A1 Jul. 4, 2013

(30) Foreign Application Priority Data

Dec. 30, 2011 (AT) ..... A 1909/2011

(51) Int. Cl.

| | |
|---|---|
| ***F04B 17/03*** | (2006.01) |
| ***F04B 9/113*** | (2006.01) |
| ***F04B 49/02*** | (2006.01) |
| ***F04B 49/06*** | (2006.01) |

(52) U.S. Cl.

CPC ..... *F04B 17/03* (2013.01); *F04B 9/113* (2013.01); *F04B 49/022* (2013.01); *F04B 49/06* (2013.01); *F04B 2207/02* (2013.01); *Y10T 137/0391* (2015.04); *Y10T 137/7769* (2015.04)

(58) Field of Classification Search

CPC ..... F04B 17/03; F04B 49/06; F04B 49/022; F04B 9/113

USPC ..... 417/497, 375, 379, 44.1, 44.2, 397

See application file for complete search history.

(56) References Cited

U.S. PATENT DOCUMENTS

| | | | | |
|---|---|---|---|---|
| 3,385,217 | A * | 5/1968 | Bles | 417/287 |
| 3,440,967 | A * | 4/1969 | Pennther | 417/206 |
| 3,486,459 | A * | 12/1969 | Eltze | 418/126 |
| 3,869,655 | A * | 3/1975 | Sousek | 318/591 |
| 4,308,152 | A * | 12/1981 | Newman et al. | 507/277 |
| 4,309,152 | A | 1/1982 | Hagen | |
| 4,723,412 | A * | 2/1988 | Buschmann | 60/545 |
| 5,093,052 | A * | 3/1992 | Wurl et al. | 264/40.1 |
| 5,253,981 | A | 10/1993 | Yang et al. | |
| 5,483,826 | A * | 1/1996 | Schultz et al. | 73/146.5 |
| 5,778,671 | A | 7/1998 | Bloomquist et al. | |

(Continued)

FOREIGN PATENT DOCUMENTS

| | | |
|---|---|---|
| CH | 392755 | 5/1965 |
| DE | 2146290 | 3/1973 |

(Continued)

OTHER PUBLICATIONS

Applied Industrial Technologies "Hydraulic Symbols".*

(Continued)

*Primary Examiner* — Charles G Freay
*Assistant Examiner* — Lilya Pekarskaya
(74) *Attorney, Agent, or Firm* — Greenblum & Bernstein, P.L.C.

(57) ABSTRACT

Hydraulic drive and method for driving a pressure booster of a high-pressure apparatus. The hydraulic drive includes a pressure medium pump having one of a constant displacement pump and a pump conveying a constant volume per revolution, a servo motor coupled to drive the pump, and a controller structured to at least one of electrically control, regulate and switch the servo motor, which is arranged on at least one of a low pressure side and a high pressure side of the pressure booster.

14 Claims, 1 Drawing Sheet

(56) References Cited

U.S. PATENT DOCUMENTS

| | | | | |
|---|---|---|---|---|
| 5,971,714 | A * | 10/1999 | Schaffer et al. | 417/44.2 |
| 5,977,739 | A * | 11/1999 | Ohsawa | 318/685 |
| 6,068,448 | A * | 5/2000 | Muratsubaki et al. | 417/44.2 |
| 6,135,719 | A * | 10/2000 | Yoder | F04B 9/105 137/551 |
| 6,379,119 | B1 * | 4/2002 | Truninger | 417/22 |
| 7,080,792 | B2 * | 7/2006 | Muratsubaki et al. | 239/67 |
| 2007/0054007 | A1 * | 3/2007 | Yamaura | B29C 45/82 425/587 |
| 2008/0063537 | A1 * | 3/2008 | Williamson | 417/38 |
| 2008/0202841 | A1 * | 8/2008 | Biener | B62D 5/093 180/403 |
| 2010/0040483 | A1 * | 2/2010 | Berger et al. | 417/205 |
| 2010/0099537 | A1 * | 4/2010 | Maten | F16H 61/2807 477/130 |

FOREIGN PATENT DOCUMENTS

| | | |
|---|---|---|
| DE | 8127250 | 8/1988 |
| DE | 19680008 | 1/2002 |
| DE | 10331191 | 1/2005 |
| EP | 0810370 | 12/1997 |
| FR | 1243627 | 10/1960 |
| JP | 9264261 | 10/1997 |
| JP | 10169567 | 6/1998 |
| JP | 2001-500953 | 1/2001 |
| JP | 2001090669 | 4/2001 |
| JP | 2009-6389 | 1/2009 |

OTHER PUBLICATIONS

Chiang et al. "A comparison of an AC-Servo motor driving variable rotational speed and a variable displacement pump-controlled systems for velocity control", Sep. 18, 2008, Taipei, Taiwan.*

Search Report of Austrian Patent Office in related Application No. A1909/2011, dated Jul. 4, 2012.

Search Report of European Patent Office in counterpart Application No. 12455007.0, dated Feb. 27, 2014.

English-language translation of Japanese Office Action in counterpart Application No. 2012-267662, dated Dec. 24, 2013.

* cited by examiner

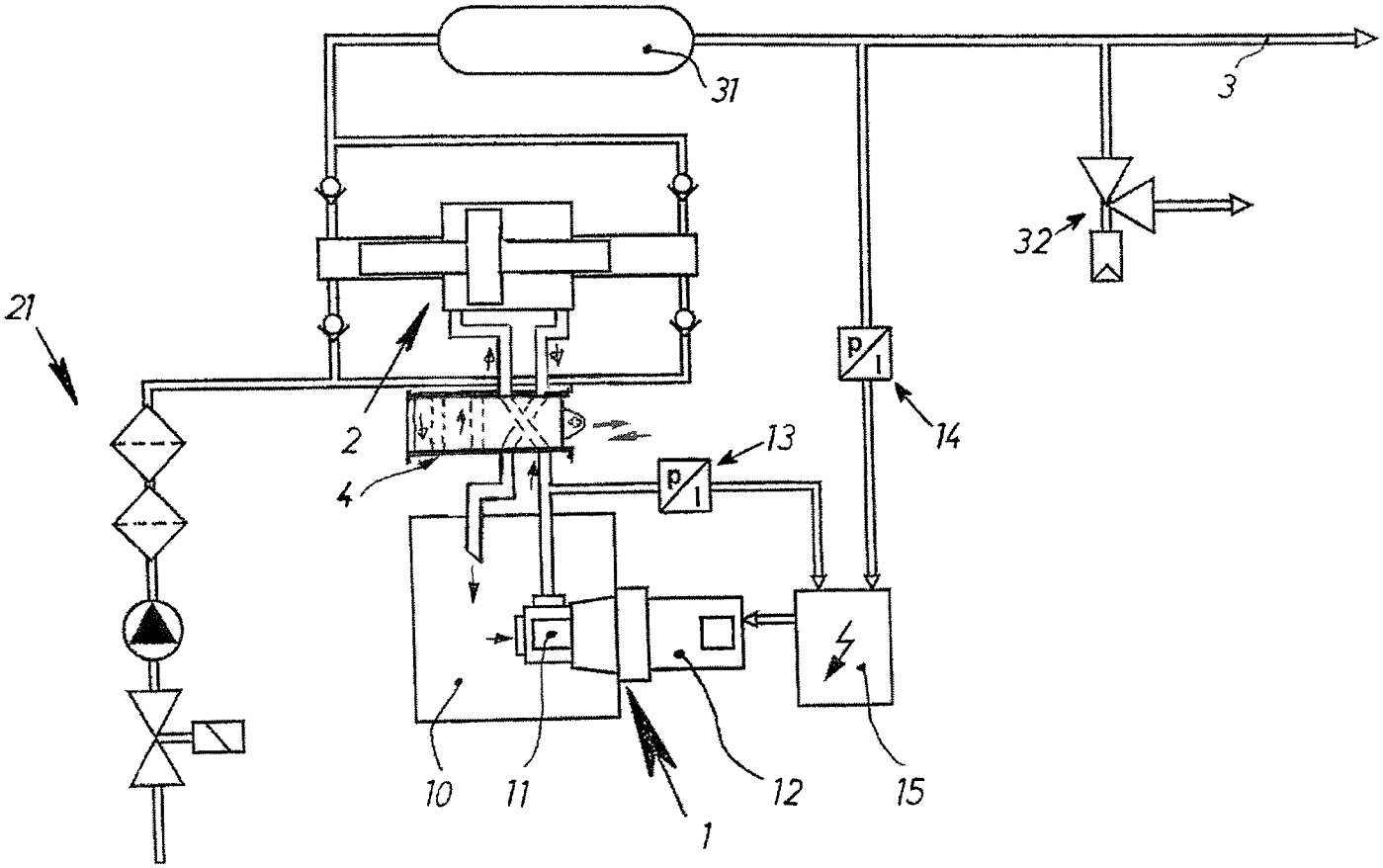
3
32
14
15
13
12
31
1
11
10
2
4
21

HYDRAULIC DRIVE FOR A PRESSURE BOOSTER

CROSS-REFERENCE TO RELATED APPLICATIONS

The present application claims priority under 35 U.S.C. § 119 of Austrian Patent Application No. A 1909/2011 filed Dec. 30, 2011, the disclosure of which is expressly incorporated by reference herein in its entirety.

BACKGROUND OF THE INVENTION

1. Field of the Invention

The invention relates to a hydraulic drive with a quantity control and/or pressure control for a pressure booster of a high-pressure apparatus, comprising essentially a motor drive with a pump for a pressure medium as well as a control.

2. Discussion of Background Information

Modern high-pressure apparatuses operate with pressures of up to 10,000 bar and more and make extremely high mechanical demands on the materials of the apparatus components, which often lie in the limit range of the high-strength alloys with respect to mechanical tensile strength and alternate strength. Although pressure relief valves are provided throughout therein for sudden interruptions of the flow of the fluid in the high-pressure line, an increase in pressure can cause material damage until the valve is triggered.

The pressure boosters as described above operate according to the principle of hydraulic pressure boosters, as is known to those practiced in the art.

A drive of a pressure booster usually takes place via a hydraulic part with a quantity control and/or pressure control of a hydraulic fluid, which part is essentially formed by a motor drive and a pump part.

An efficient long-term pumping is essential for the hydraulic part of a high-pressure apparatus, a direct adjustability with shutdowns or blockages with an avoidance of overpressure peaks and a low pulsation in the high-pressure section of the apparatus.

According to the prior art, piston pumps are usually chosen as a hydraulic drive for a pressure booster, which have a high power density for high pressures with good volumetric efficiency and good hydraulic mechanical efficiency with the most accurate adjustability of the piston displacement. These pumps are piston pumps expertly formed throughout by several parallel units, which as axial piston machines can be embodied in bent axis design or as radial piston pumps and have special advantages.

Further, these are self-adjusting gaps with hydrostatic/hydrodynamic stresses of axial piston machines, while there is also the possibility of a direct quantity control of the fluid by axial angle adjustment drive/pump system.

SUMMARY OF THE INVENTION

In accordance with the demands on technical progress in the sector of high-pressure apparatuses, i.e., the safety of the plant control, the minimization of the pressure surges and thus the minimization of the material overloads of components in the high pressure section, the increase in the service life of the apparatus, the increase in energy efficiency, the reduction of power consumption in the case of pressure boosters at rest and the improved performance of the high-pressure apparatus, embodiments of the invention create a hydraulic unit for a high pressure booster of the type mentioned at the outset, the use of which overcomes the disadvantages of the prior art.

According to embodiments, a generic drive for a pressure booster of a high pressure apparatus includes a constant displacement pump, or a pump which conveys a constant volume per revolution, driven by a servomotor that together form a hydraulic drive. The servomotor can be electrically controlled, regulated and/or switched on the low-pressure side and/or on the high-pressure side.

There are multiple advantages of the hydraulic drive for a pressure booster according to the invention. One advantage is to be seen in that essentially no pulsation is produced during the insertion of a high-pressure medium into a filler, or no chipping off of brittle materials upon ejection with water jet cutting.

Pressure fluctuations when switching the cutting valve on and off are kept low by a use of the new hydraulic drive, whereby an overloading of the components is largely avoided.

A change in quantity during the removal of high pressure fluid does not require any direct plant adaptation.

A soft start of the high pressure plant takes place in a favorable manner with particularly low energy expenditures.

In a further development of the invention, a gerotor pump is used as a constant displacement pump. Due to an adapted tooth form, gerotor pumps have favorable tooth engagement ratios and thus low volume flow pulsation at high operating pressures of approx. 300 bar with good efficiency. Pumps of this type are also characterized by low sound pressure levels.

A servo drive can contain a direct-current motor, an asynchronous motor or a synchronous motor, that is, any type of electric motor. The distinction lies only in the triggering of the motor, which is carried out by a closed control loop to which according to the embodiments, signals can be fed by the pressure booster on the low pressure side and/or on the high pressure apparatus on the high pressure side.

In terms of installation engineering and process engineering, but also with respect to a minimization of energy consumption, it is advantageous if the servo motor is embodied or formed as a frequency-controlled drive motor.

Embodiments of the invention are directed to a hydraulic drive for a pressure booster of a high-pressure apparatus. The hydraulic drive includes a pressure medium pump having one of a constant displacement pump and a pump conveying a constant volume per revolution, a servo motor coupled to drive the pump, and a controller structured to at least one of electrically control, regulate and switch the servo motor, which is arranged on at least one of a low pressure side and a high pressure side of the pressure booster.

According to embodiments of the instant invention, the hydraulic drive can have at least one of a quantity control and a pressure control.

In accordance with other embodiments, when the pressure medium pump includes the constant displacement pump, the constant displacement pump can be a gerotor pump.

Further, in a closed control loop, the controller may be structured and arranged to receive signals from at least one of a signal generator on the low pressure side and a signal generator on the high pressure side in order to trigger operation of the servo motor. The signal generator on the low pressure side can include a low pressure pickup/converter, and the signal generator on the high pressure side can include a high pressure pickup/converter. Further, the low pressure pickup/converter and the high pressure pickup/converter may be structured to convert a sensed pressure to an electric signal.

According to other embodiments, wherein an operating pressure on the low pressure side can be within a range of 200-400 bar. Additionally or alternatively, an operating pressure on the high pressure side may be within a range up to 10,000 bar. Further, the operating pressure on the high pressure side can be within a range of 300-6000 bar.

In accordance with still other embodiments of the invention, the servo motor may include a frequency-controlled drive motor.

Embodiments of the present invention are directed to a method for driving a pressure booster of a high-pressure apparatus. The method includes controlling a servo motor based upon pressures on at least one of a low pressure side and a high pressure side of the pressure booster, and driving a pressure medium pump via the controlled servo motor to drive a hydraulic ram of the pressure booster.

According to embodiments, the pressure booster can include two hydraulic rams driven by the pressure medium pump.

In accordance with other embodiments of the invention, the pressure medium pump can include at least one of a constant displacement pump and a pump conveying a constant volume per revolution.

In accordance with still yet other embodiments of the present invention, the method can also include controlling, in a closed control loop, a triggering operation of the servo motor based upon signals received from signal generators located on the low pressure side and on the high pressure side. Still further, a low pressure pickup/converter can be arranged in the closed control loop as the signal generator on the low pressure side, and a high pressure pickup/converter may be arranged in the closed control loop as the signal generator on the high pressure side. The low pressure pickup/converter and the high pressure pickup/converter can convert a sensed pressure to an electric signal.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein:

FIG. 1 schematically illustrates a high pressure apparatus in accordance with embodiments of the invention.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

FIG. 1 diagrammatically shows a high pressure apparatus with a conveyor line 3, a pulsation damper 31 and a pressure relief valve 32 on the outlet side.

A pressure booster 2 can be supplied with high-pressure fluid via series units 21, such as, for example, low pressure filters 22, booster pump 23, and shut-off valve 24.

A pressure booster 2, which can, e.g., have two hydraulic rams, may be moveable by a pressure medium 10 via a hydraulic unit 1 formed by, e.g., a pump 11, e.g., a constant flow rate pump and/or a pump conveying a constant volume per revolution, and a motor 12, e.g., a servo motor, through a switch block 4. An electronic control 15 of motor 12 can be arranged to receive electrical feedback signals, e.g., by way of a closed control loop, from a high pressure pickup/converter 14 and/or from a low pressure pickup/converter 13 in order to electrically control, regulate or switch motor 12. High and low pressure pickup/converters 14 and 13 convert a sensed pressure into an electrical signal, such as a current signal, having a magnitude related to the magnitude of the pressure. By way of non-limiting example, the operating pressure on the low pressure side can be in a range of, e.g., 200-400 bar, while the operating pressure on the high pressure side can be in a range of, e.g., 3000-6000 bar, and up to 10,000 bar in, e.g., test systems.

A feed of pressure booster 2 can be carried out in a known manner, e.g., by bent axis displacement pumps with hydraulic mechanical quantity controllers with parallel acting cylinders, the conveyor flows of which are added together.

In the case of direct axial alignment, an immediate reduction of the pump performance of pressure medium to zero can be achieved despite a motor rotation.

A high pressure apparatus such as, for example, a water jet cutting plant usually has longer lasting work phases, so that a drive of a pressure booster via a servo motor and a pump with constant quantity pumping must appear far removed from a conventional technically advantageous solution to one with skill in the art.

Surprisingly, it has been shown that a use of a constant displacement pump 11 driven by a servo motor 12 has advantages when used as part of a hydraulic drive 1 in accordance with embodiments of the invention for a pressure booster 2 of a high pressure apparatus.

Among other things, this arrangement results in extremely low pulsations of a high-pressure water jet, which does not cause any chipping in the case of brittle materials even when cutting a through hole. Moreover, this may advantageously be achieved through the use of a gerotor pump 11 for a hydraulic drive 1 of a pressure booster 2.

According to embodiments, hydraulic drive 1 can be utilized in accordance with the invention to cause low pulsations and in particular slight high-pressure fluctuations in the case of a stop/go operation of a system. In this way, the service life of the high pressure components is increased.

In an advantageous manner with closed high-pressure nozzles, no movement of the servo motor and no power consumption of the same take place. In this manner, the start power consumption can be reduced with a soft start of the hydraulic drive 1.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A hydraulic drive structured and arranged for a hydraulic ram pressure booster for a high-pressure apparatus for water jet cutting, the hydraulic drive comprising: a constant displacement pressure medium pump, wherein the constant displacement pump is a gerotor pump;

a servo motor coupled to the constant displacement pump and operable to intermittently drive the constant displacement pump;

a servo motor controller operable to vary a rotational speed of the servo motor;

a two-position switch block having two operable positions, and the two-position switch block is operable to convey a pressure medium to one of two chambers of the hydraulic ram pressure booster in dependence upon a position of the two-position switch block;

a pulsation damper coupled to a line that conveys the pressure medium;

a low pressure signal generator that senses pressure from the pressure medium pump at a location between the pressure medium pump and the two-position switch block and outputs signals to the servo motor controller; and a high pressure signal generator that senses pressure at a location downstream of the pulsation damper and outputs signals to the servo motor controller, wherein the constant displacement pressure medium pump conveys the pressure medium to the two-position switch block;

wherein the servo motor drives the constant displacement pump to drive the hydraulic ram pressure booster via the two-position switch block with a quantity control of the pressure medium fed to the hydraulic ram pressure booster governed by the rotational speed of the servo motor;

wherein the servo motor controller is arranged in a closed feedback control loop with the low pressure signal generator on a low pressure side and the high pressure signal generator in order to trigger operation of the servo motor and to supply the pressure medium to the high-pressure apparatus for water jet cutting.

2. The hydraulic drive according to claim 1, the low pressure signal generator comprises a low pressure pickup/converter, and the high pressure signal generator comprises a high pressure pickup/converter.

3. The hydraulic drive according to claim 1, wherein an operating pressure sensed by the low pressure signal generator is within a range of 200-400 bar.

4. The hydraulic drive according to claim 1, wherein an operating pressure sensed by the high pressure signal generator is within a range up to 10,000 bar.

5. The hydraulic drive according to claim 4, wherein the operating pressure sensed by the high pressure signal generator is within a range of 300-6000 bar.

6. The hydraulic drive according to claim 1, wherein the servo motor comprises a frequency-controlled drive motor.

7. A method for driving a hydraulic drive for a hydraulic ram pressure booster for a high-pressure water jet cutting apparatus, the hydraulic drive comprising: a constant displacement pump, wherein the constant displacement pump is a gerotor pump; a servo motor coupled to the constant displacement pump and operable to intermittently drive the constant displacement pump; and a servo motor controller operable to vary a rotational speed of the servo motor, the method comprising:

conveying a pressure medium to a two-position switch block having two operable positions with the constant displacement pump, wherein the two-position switch block is operable to convey the pressure medium to one of two chambers of the hydraulic ram pressure booster in dependence upon a position of the two-position switch block, driving the constant displacement pump via the servo motor to drive the hydraulic ram pressure booster via the two-position switch block;

coupling a pulsation damper to a line that conveys the pressure medium;

sensing, with a low pressure signal generator, pressure from the constant displacement pump at a location between the constant displacement pump and the two-position switch block and outputting signals to the servo motor controller; and sensing, with a high pressure signal generator, pressure at a location downstream of the pulsation damper and outputting signals to the servo motor controller; and controlling a speed of the servo motor to control a quantity of the pressure medium fed to the hydraulic ram pressure booster, wherein controlling the servo motor comprises using a closed feedback control loop with the low pressure signal generator and the high pressure signal generator in order to trigger operation of the servo motor based upon pressures sensed by the low pressure signal generator and the high pressure signal generator and to supply the pressure medium to the high-pressure water jet cutting apparatus.

8. The method according to claim 7, wherein the pressure booster comprises two hydraulic rams driven by the constant displacement pump.

9. The method according to claim 7, wherein the low pressure signal generator is a low pressure pickup/converter and the high pressure signal generator is a high pressure pickup/converter.

10. The method according to claim 7, wherein an operating pressure sensed by the low pressure signal generator is within a range of 200-400 bar.

11. The method according to claim 7, wherein an operating pressure sensed by the high pressure signal generator is within a range up to 10,000 bar.

12. The method according to claim 11, wherein the operating pressure sensed by the high pressure signal generator is within a range of 300-6000 bar.

13. The method according to claim 7, wherein the servo motor comprises a frequency-controlled drive motor.

14. A hydraulic drive structured and arranged for a hydraulic ram pressure booster for a high-pressure water jet cutting apparatus, the hydraulic drive comprising:

a pressure medium pump that is one of a constant displacement pump and a pump conveying a constant volume per revolution, wherein the pressure medium pump is a gerotor pump;

a servo motor coupled to the pressure medium pump and operable to intermittently drive the pressure medium pump; and a servo motor controller operable to vary a rotational speed of the servo motor;

a two-position switch block having two operable positions and the two-position switch block is operable to convey a pressure medium to one of two chambers of the hydraulic ram pressure booster in dependence upon a position of the two-position switch block;

a pulsation damper coupled to a line that conveys the pressure medium;

a low pressure signal generator that senses pressure from the pressure medium pump at a location between the pressure medium pump and the two-position switch block and outputs signals to the servo motor controller; and a high pressure signal generator that senses pressure at a location downstream of the pulsation damper and outputs signals to the servo motor controller, wherein the pressure medium pump conveys the pressure medium to the two-position switch block having two operable positions and the two-position switch block is operable to convey the pressure medium to one of two chambers of the hydraulic ram pressure booster in dependence upon a position of the two-position switch block, wherein the servo motor drives the pressure medium pump to drive the hydraulic ram pressure booster via the two-position switch block with a quantity control of the pressure medium fed to the hydraulic ram pressure booster governed by the rotational speed of the servo motor, and wherein the servo motor controller is arranged in a closed feedback control loop with the low pressure signal generator on a low pressure side and the high pressure signal generator in order to trigger operation of the servo motor and to supply the pressure medium to the high-pressure water jet cutting apparatus.

* * * * *